United States Patent [19]

de Bruyne

[11] 3,998,435

[45] Dec. 21, 1976

[54] OSCILLATING STIRRERS

[76] Inventor: Norman Adrian de Bruyne, 3700 Brunswick Pike, Princeton, N.J. 08540

[22] Filed: Aug. 22, 1975

[21] Appl. No.: 606,770

Related U.S. Application Data

[63] Continuation-in-part of Ser. No. 545,140, Jan. 29, 1975, abandoned.

[52] U.S. Cl. ..... 259/114; 259/108

[51] Int. Cl.[2] ..... B01F 13/00

[58] Field of Search ..... 259/99, 108, 112, 113, 259/114, 116, 117, 122, 123, 124

[56] References Cited

UNITED STATES PATENTS

| | | | |
|---|---|---|---|
| 3,332,669 | 7/1967 | Colonna | 259/113 |
| 3,484,204 | 12/1969 | Caviness | 259/113 X |
| 3,913,895 | 10/1975 | De Bruyne | 259/118 |
| 3,955,802 | 5/1976 | De Bruyne | 259/117 |

*Primary Examiner*—Leonard D. Christian
*Assistant Examiner*—Alan Cantor
*Attorney, Agent, or Firm*—William F. Frank

[57] ABSTRACT

An oscillatory stirring apparatus for liquids in a container comprising a stirring assembly attachable to said container and means to supply at least two cyclically alternating flows of air under positive and negative pressures to said stirring assembly, said stirring assembly comprising a housing containing at least two pressure-activated chambers spacedly arranged within said housing, a stirring rod dependingly supported within said housing, means interconnecting a portion of said rod within said housing with each of said chambers, means on the exterior of said housing to connect said chambers to said air flow supply means and means to secure said housing to said container in sealing relationship with an opening in said container.

13 Claims, 27 Drawing Figures

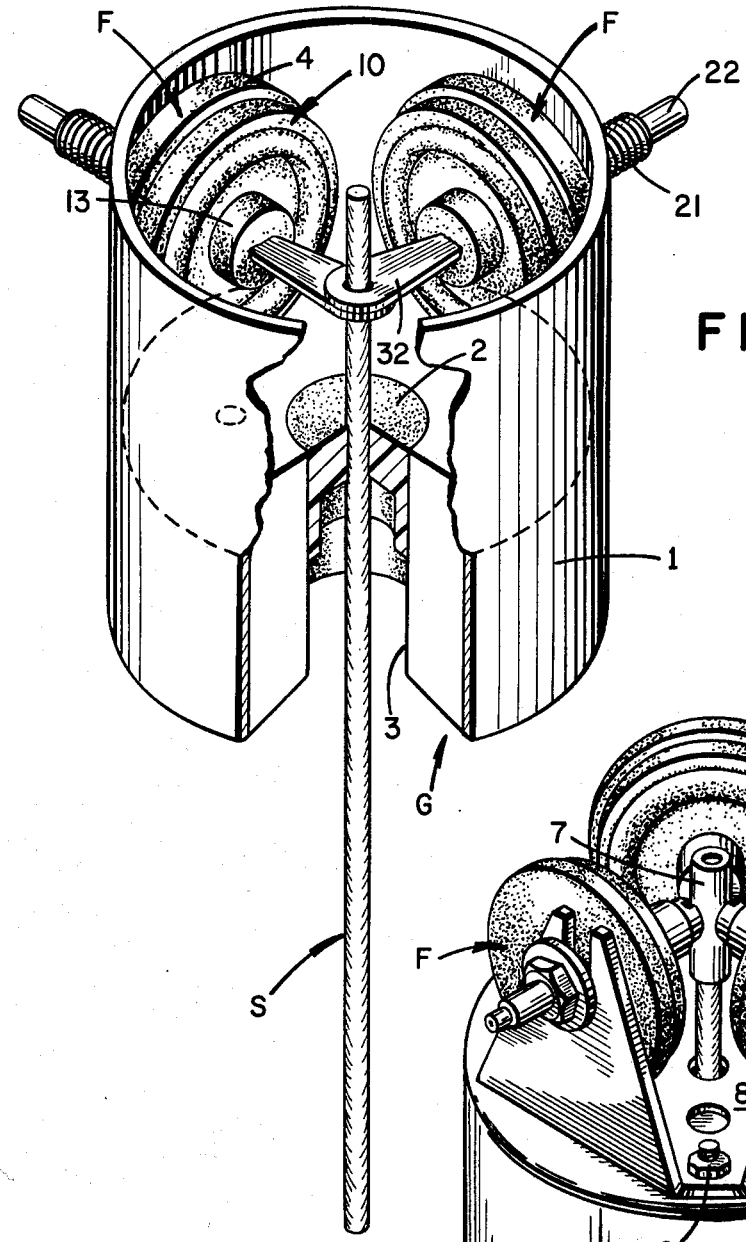
FIG. I
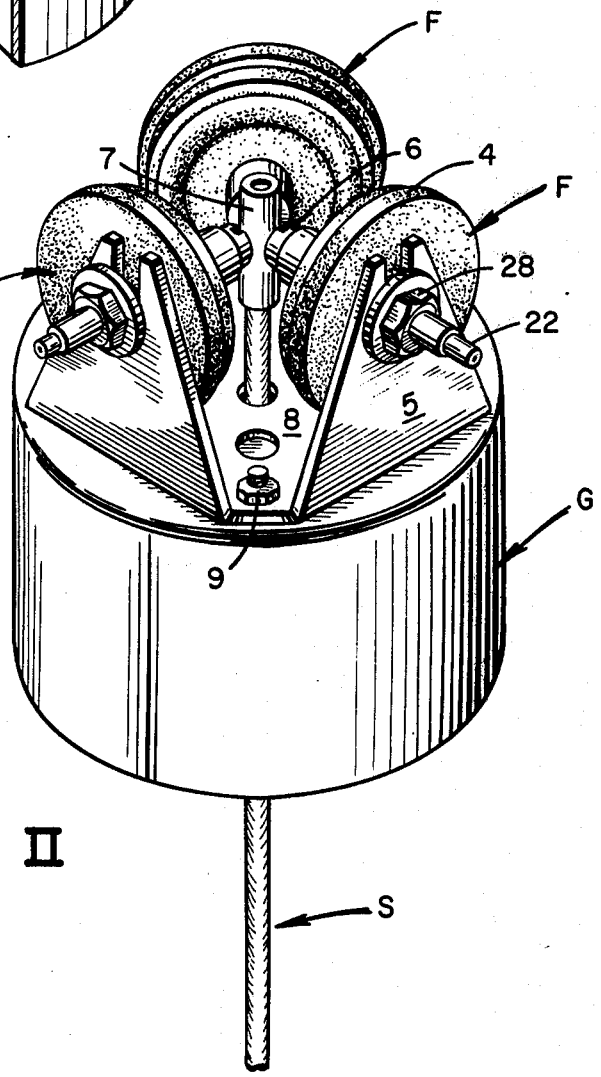
FIG. II

FIG. IIIa
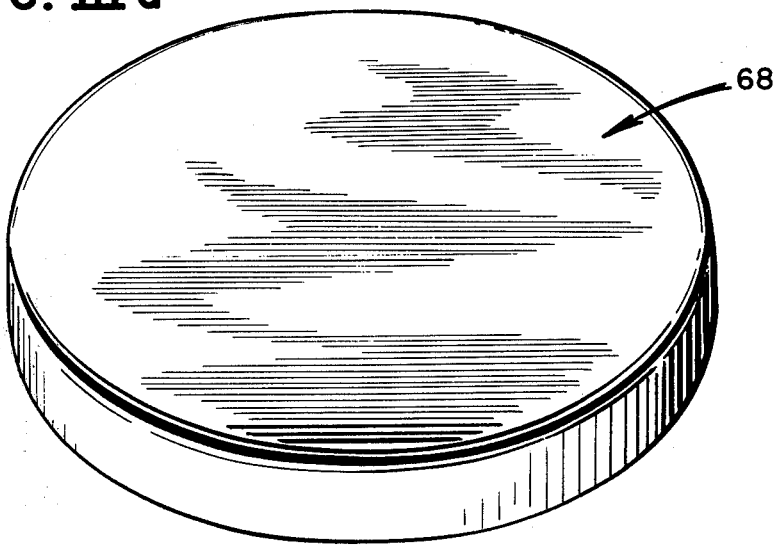
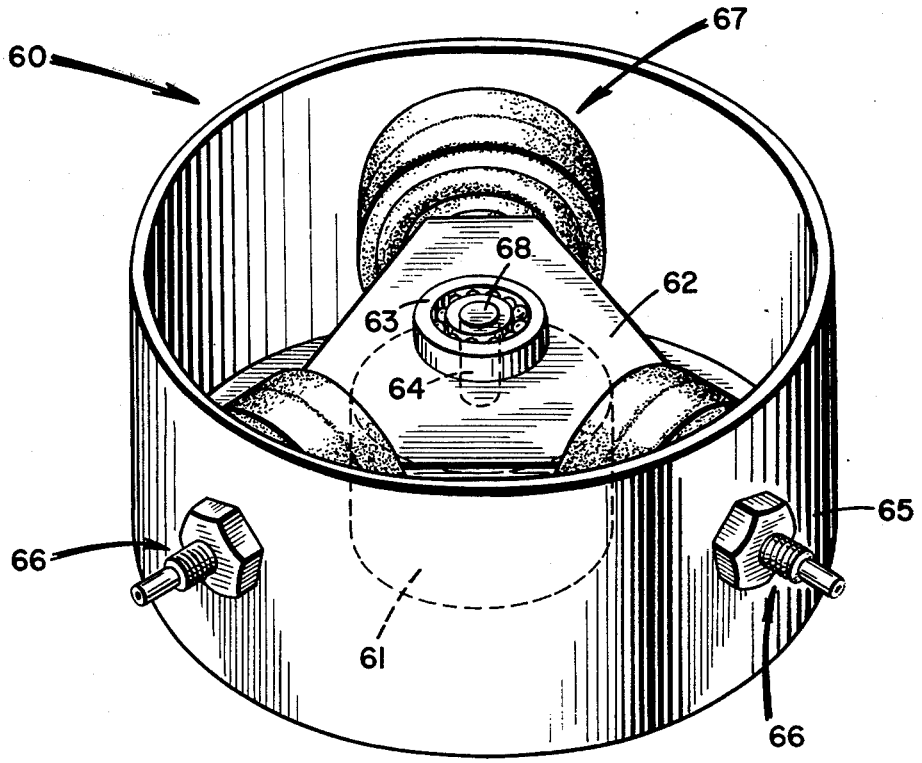
FIG. III

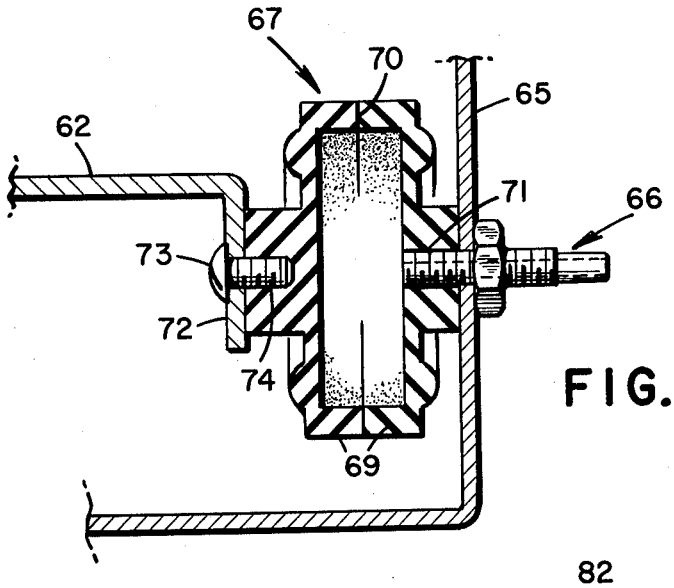
FIG. IV
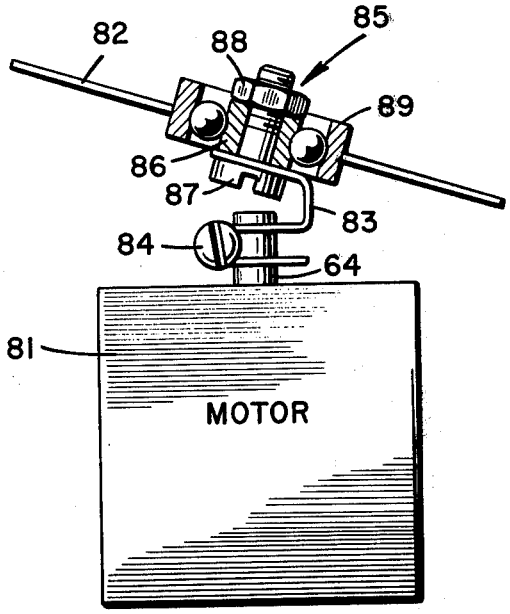
FIG. VI
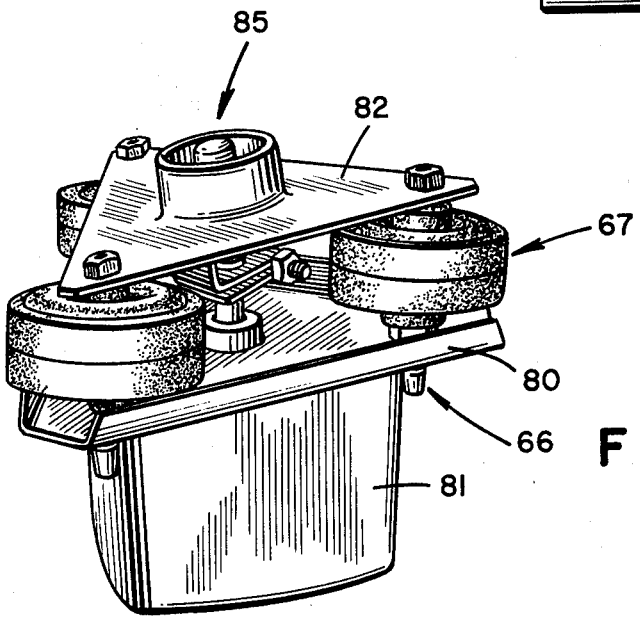
FIG. V

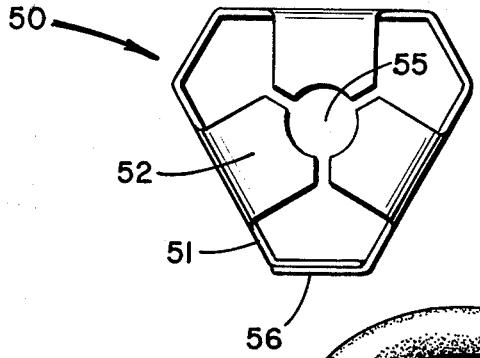
FIG. VII
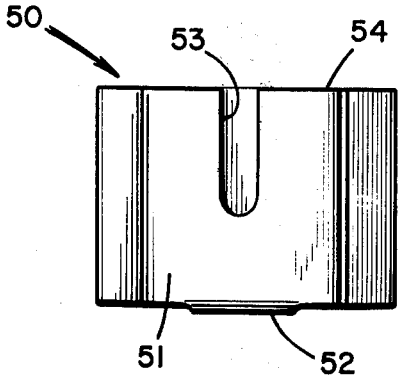
FIG. VIII
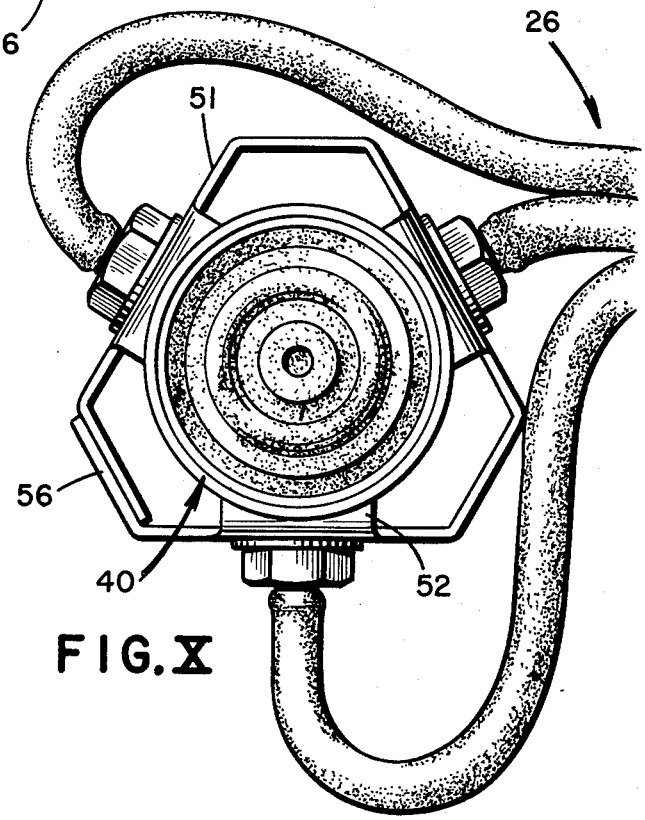
FIG. X
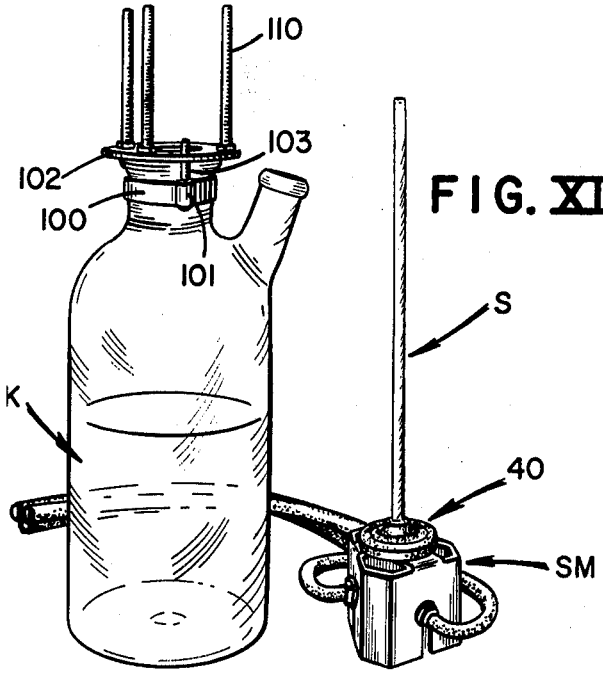
FIG. XII
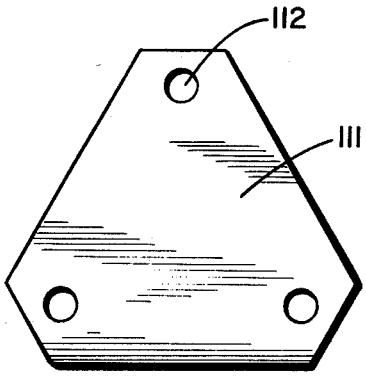
FIG. XIII

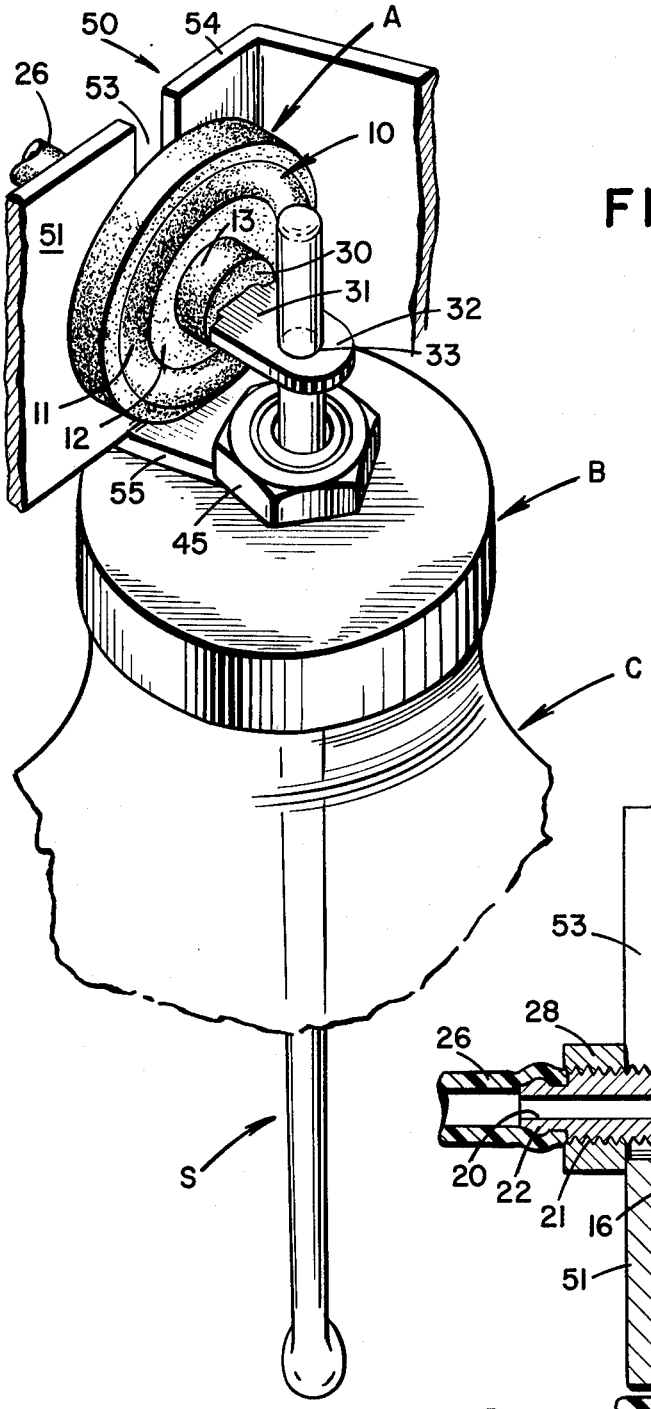
FIG. IX
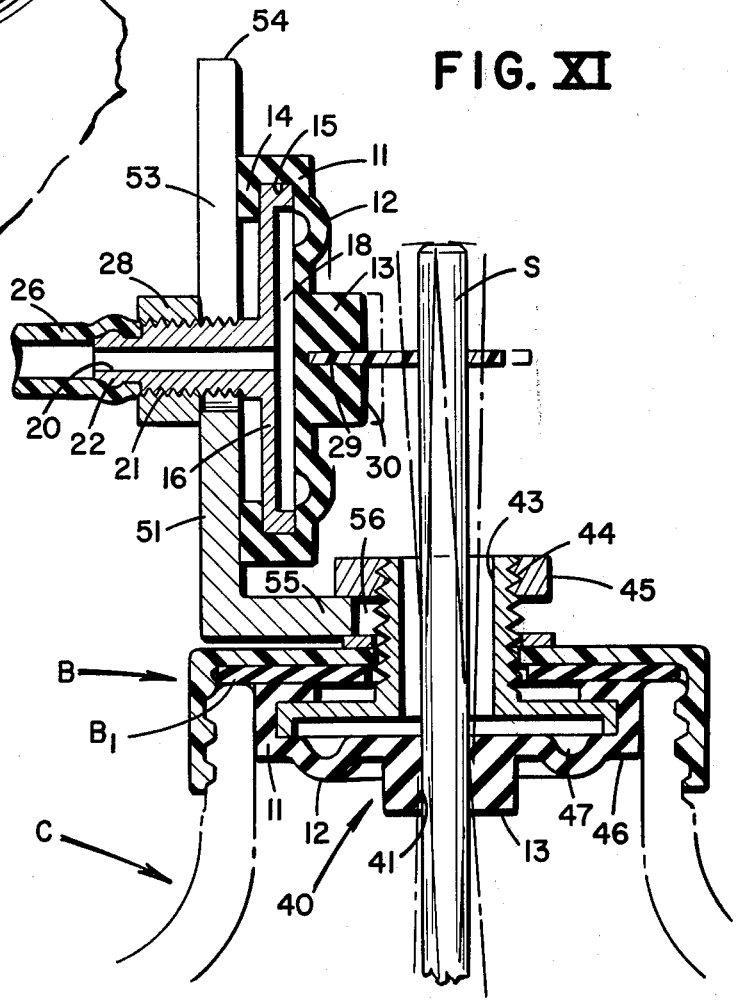
FIG. XI

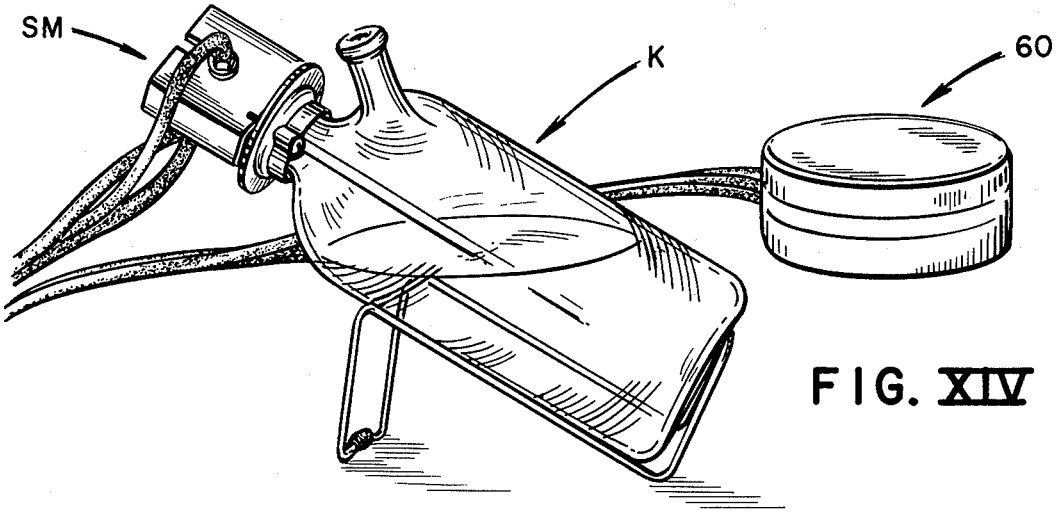
FIG. XIV
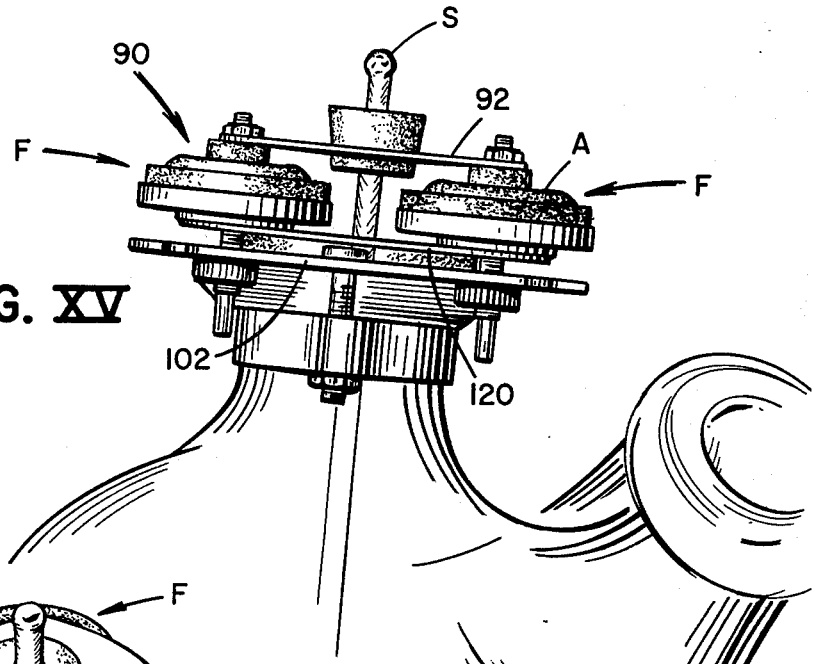
FIG. XV
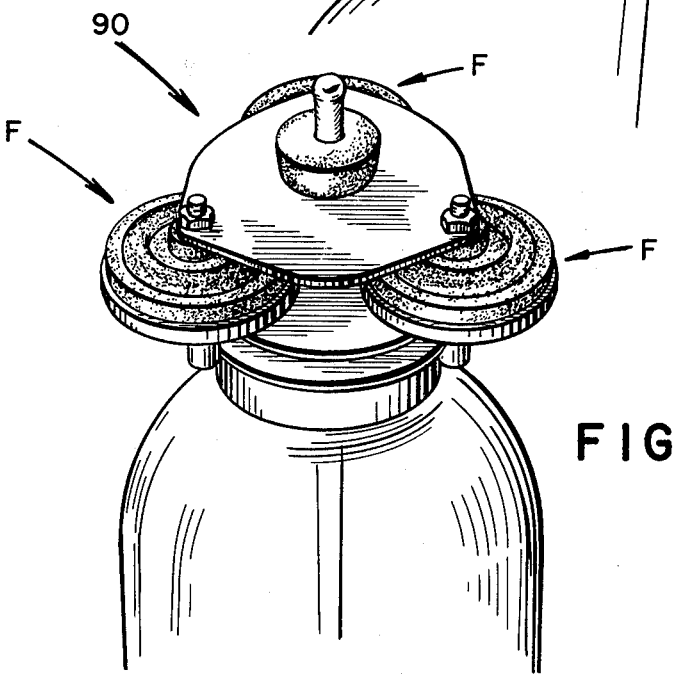
FIG. XVI

FIG. XVII
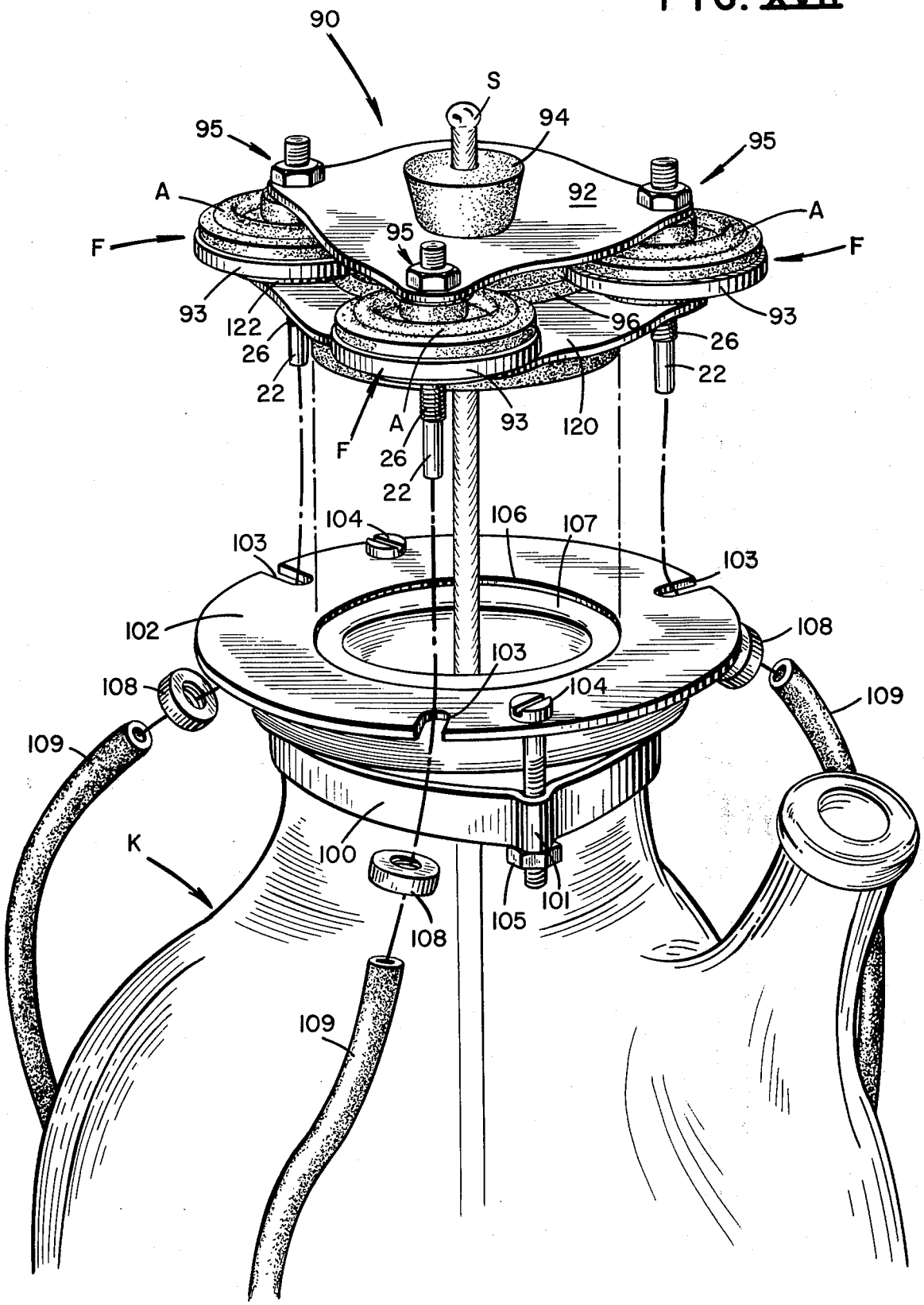

FIG. XVIII
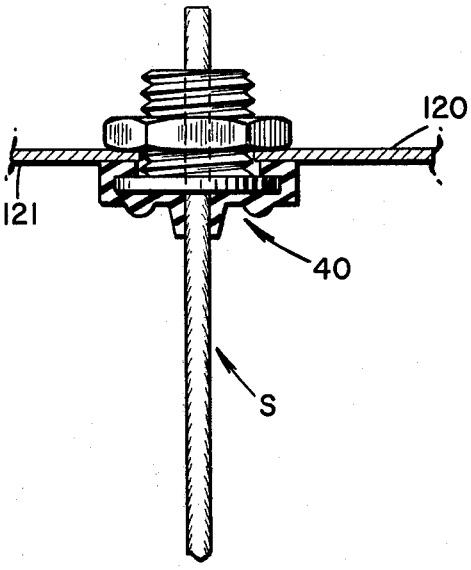
FIG. XIX
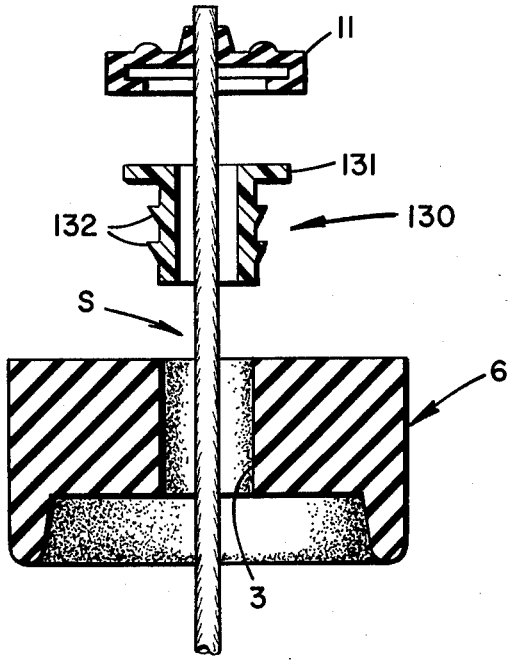
FIG. XX
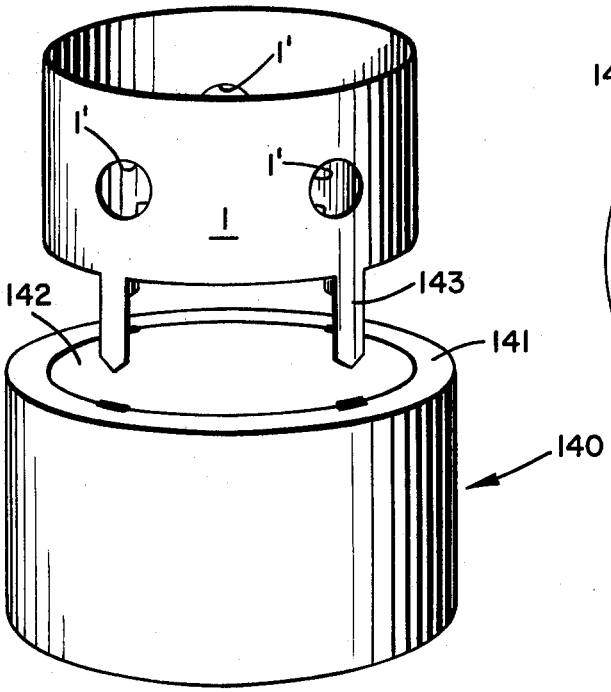
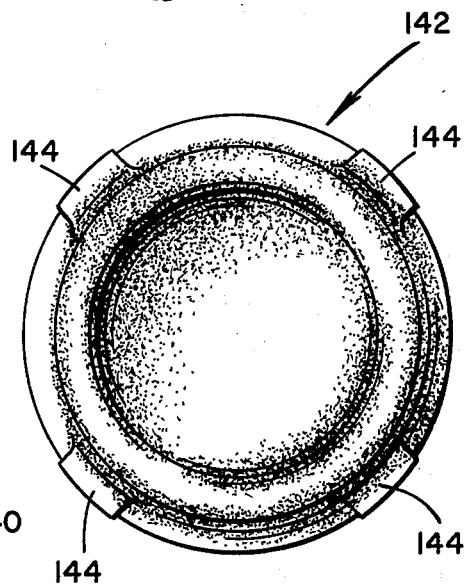
FIG. XXI

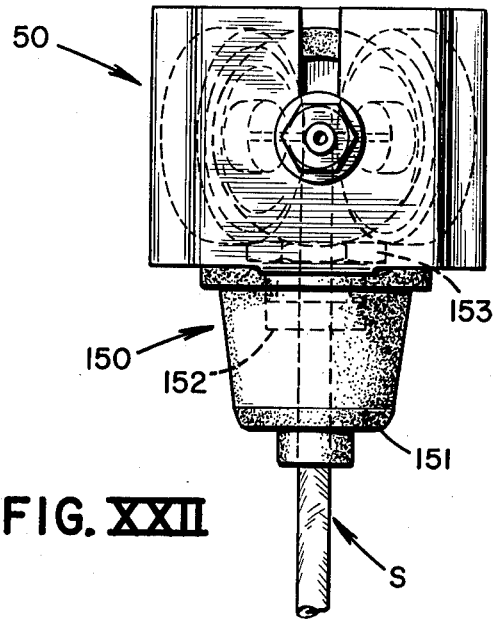
FIG. XXII
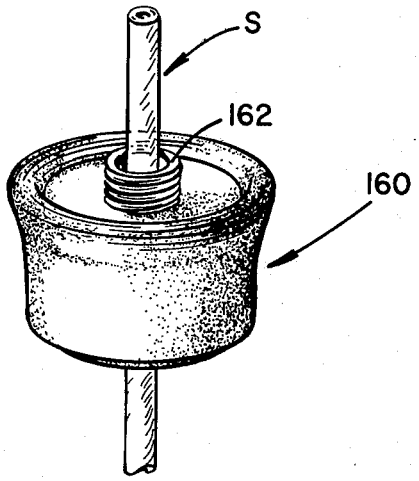
FIG. XXIV
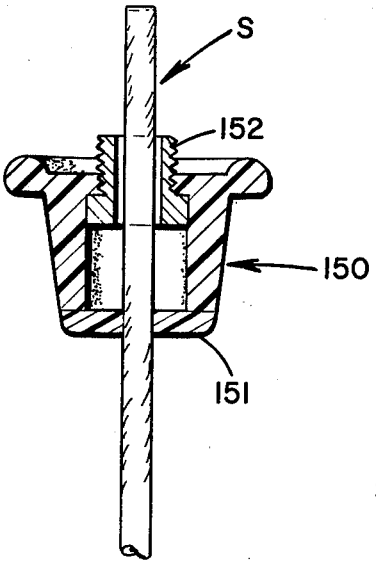
FIG. XXIII
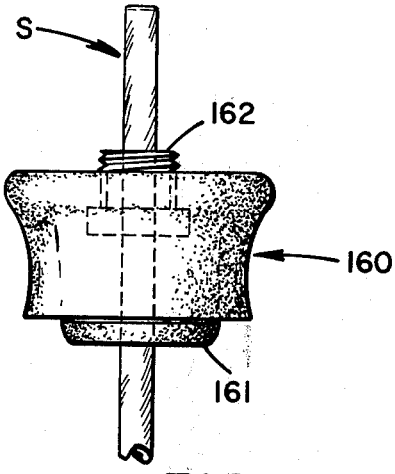
FIG. XXV
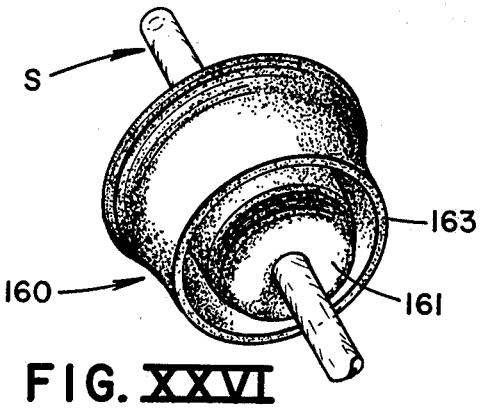
FIG. XXVI

OSCILLATING STIRRERS

This application is a continuation-in-part of my co-pending application Ser. No. 545,140, filed Jan. 29, 1975, and now abandoned.

The present invention is in the field of laboratory stirrers which are oscillated by an alternating current of air (ACA) which has alternating stages of positive and negative pressure. More particularly the present invention utilizes a plurality of such alternating currents of air.

BACKGROUND OF THE INVENTION AND PRIOR ART

In the matter of stirring liquids by apparatus in lieu of hand stirring, the attempt has always been to obtain circulation of the liquid composition within the container. The greater degree of circulation results in improved intermingling and homogenizing of the composition for better dispersion of particles within the liquid. In many instances, heat must be applied to the container in addition to the stirring action to achieve the desired results. In other instances, such as certain laboratory work, heating must be avoided, be it from external sources or as can be developed by the varied motion and operation of the stirring apparatus.

The path to be followed by the stirrer can enhance the stirring if the proper motion is imparted to the stirrer. In contrast, stirring will be ineffective if the path of the stirrer does not cause the necessary motion within the liquid composition. It is most desirable if the stirrer can impart motion to the liquid so that the liquid moves in a vertical direction and at the same time in a horizontal direction.

Some of the prior art oscillating stirrers were of a type which could be referred as plungers, that is the stirrer is moved up and down in a generally vertical plane. The stirrer frequently has some device attached at or near the end portion in the liquid to impart motion to the liquid. In some instances the stirrer actuator will impart heat to the liquid which may be undesirable particularly in laboratory work. To reduce or eliminate the heat problem, use began to be made of stirrers driven by application of alternating, positive and negative pressures to the interior of a reactor vessel containing vertically moving rod having an enlargement on the lower end. U. S. Pat. No. 3,484,204 is such type stirrer. My co-pending U. S. Pat. application No. 458,846 is a marked improvement over the prior art in that a pair of novel abutment plates are secured to the inner surface of a diaphragm supporting the stirring rod and stroke a metal disk into the diaphragm. The abutment plates are of unequal length and height in accordance with the principles of their design as disclosed in this application. Use is made of single phase ACA to impart motion to the diaphragm and the result is that the stirring motion is in an inclined elliptical path lined in X, Y and Z planes. The stirring apparatus of this application can be secured to the various types of closures for flasks or other containers, such as the Corning Glass "Fleaker" flask or the familiar Kontes flask but the flasks should be kept vertical.

The application of the apparatus in my co-pending U. S. Pat. application No. 458,846 with the "Fleaker" flask and a Kontes flask has been quite successful. However, it has been found that occasionally under certain working conditions there was a build-up of pressure particularly in the Fleaker flask which could impair or even halt the flexing of the diaphragm. Also it was found that application of the apparatus disclosed in that application was difficult with closures of varying types also used with laboratory flasks.

SUMMARY OF THE PRESENT INVENTION

The present invention discloses oscillatory stirring apparatus in which either two-phase ACA or three-phase ACA is applied to a stirring assembly attached to a closure for a flask or container in order to achieve an orbital stirring path in the horizontal X, Y planes. In this invention the stirring rod extends above and below a suspension diaphragm which may also provide a seal for the stirring rod within the flask and which is sealably secured to one of the various types of closures for flasks or containers. The portion of the stirring rod extending above the diaphragm and outside the flask is caused to move in an orbital path by the action of two or three expansible chambers which are cyclically, in an alternating pattern, supplied with positive and negative low pressures ACA. The orbital path of the portion of the stirring rod extending above the diaphragm in the horizontal X and Y planes normally is of a small lateral displacement in each of these planes. The resultant movement of the end of the stirring rod suspended from the diaphragm within the flask is a similar orbital pattern as the upper portion but with a lateral displacement in the horizontal X and Y planes greater than that of the upper portion in accordance with the distance of the lower end of the stirring rod from its pivotal base in the diaphragm. This two or three phase ACA system is very effective in the stirring of liquids, particularly the more viscous liquids. The stirring assembly of the present invention will permit the flasks to be placed at an angle to the vertical and yet achieve excellent agitation.

In one embodiment the present invention comprises an oscillatory stirring apparatus for liquids in a container, the apparatus comprising a stirring assembly attachable to said container and means to supply at least two cyclically alternating flows of air under positive and negative pressures to said stirring assembly, the stirring assembly itself comprising a housing containing at least two pressure activated chambers spacedly arranged within the housing, a stirring rod dependingly supported within said housing, means interconnecting a portion of said rod within said housing with each of the chambers, means on the exterior of the housing to connect said chambers to an air flow supply means and means to secure the housing to the container in sealing relationship with an opening in said container.

DESCRIPTION OF THE DRAWINGS

The present invention in its above broad aspects is depicted in the following listing of drawing figures in which varying scales have been used to more clearly present the invention. The configurations shown, and subsequently to be described, are by way of illustration only and are not limiting as to size and to the full range of application of the present invention.

FIG. I is a perspective view of one form of one embodiment of the present invention with a partial section showing application to the "Fleaker" flask closure, the perspective being seen from about 45° above the horizontal;

FIG. II is another form of one embodiment of the invention showing the application to a "Fleaker" flask and is seen from about 45° above the horizontal;

FIG. III and FIG. III*a* are perspectives of one embodiment of the air pump utilized with the present invention and comprising a portion thereof;

FIG. IV is a cross-section of one of the air pressurizing chambers of the air pump shown in FIG. III;

FIG. V is a perspective of another form of the air pump used in the present invention and forming a part thereof;

FIG. VI is an elevation view in partial section as to the means for developing the air pressure for the embodiment of the air pump shown in FIG. V;

FIG. VII is a bottom view of the support for the stirring motor in another form of the present invention;

FIG. VIII is a side view of the support for the stirring motor shown in FIG. VII;

FIG. IX is a perspective view of one of the stirring motor assemblies of the present invention;

FIG. X is a bottom view of FIG. VII with the diaphragm attached to the base of the motor support and also shows the air supply hoses;

FIG. XI is a cross-section along the plane XI—XI in FIG. IX showing the attachment of the motor pump support frame and diaphragm to a rigid plastic threaded cap;

FIG. XII is a low angle perspective in elevation showing a Kontes flask, the stirring motor of FIGS. VII–IX and the means on the Kontes flask to mount the motor;

FIG. XIII is a top view of the plate securing the motor to the flask in FIG. XI;

FIG. XIV shows the air motor of FIGS. VII–X for the stirring apparatus completely assembled and attached to a Kontes flask which is supported in an inclined position on a support;

FIG. XV shows the attachment of another embodiment of the air motor to a Kontes flask;

FIG. XVI is a perspective view of the embodiment shown in FIG. XV;

FIG. XVII is an exploded perspective view of the embodiment of the stirring apparatus shown in FIGS. XIV–XVI;

FIG. XVIII shows the modifications necessary to use the stirring motor shown in FIGS. XV and XVI with the rigid plastic threaded caps shown in FIG. XI;

FIG. XIX is a cross-section showing the modification which can be made to insert the stirring rod into a "Fleaker" closure;

FIG. XX is a perspective showing the stainless steel cylinder in which are mounted the stirring motors shown in FIG. I when the "Fleaker" flask is either the capacity less than 800 milliliters or when the flask is greater than 800 milliliters;

FIG. XXI is a bottom view of the rubber stopper used in the "Fleaker" flasks greater than 800 milliliters when the polypropylene ring surrounding the stopper has been removed;

FIG. XXII is an elevation view 45° of the employment of stirring motor of FIGS. VII–XI with one form of neoprene stopper;

FIG. XXIII is a sectional elevation view of the neoprene stopper of FIG. XXII;

FIG. XXIV is a perspective view from above of another form of neoprene stopper used with the motor shown in FIG. XXII;

FIG. XXV is an elevation view of the stopper in FIG. XXIV; and

FIG. XXVI is a perspective view from below of the stopper in FIG. XXIV.

DETAILED DESCRIPTION OF THE INVENTION

In the embodiment of the invention shown in FIG. I the plurality of diaphragm assemblies indicated as F are mounted on the inner surface of a cylindrical ring 1 which is force fitted around the Fleaker flask stopper G. This particular embodiment usually uses three of the diaphragm assemblies but one has been omitted because of the showing of the partial section. The diaphragm assemblies 10 are discussed in more detail with reference to FIGS. IX and XI. The inner end of each diaphragm bears a boss 13 which extends toward the stirring rod S. Each boss bears a link member 32 which is fitted over the stirring rod which in turn is fitted into the stopper cap G through a flexible insert 2 which is placed in a bore 3 made in the cap G. It would be noted that the stirring rod has a portion known as a linking portion extending above the upper surface of the stopper cap which is engaged by the links and a stirring portion depending into the flask below the stopper cap G. Each of the diaphragm assemblies is provided with a inlet conduit 22 extending outwardly through the wall of the stainless steel ring 1 for connection to a separate source of ACA for each diaphragm assembly and extends inwardly into each assembly. In this embodiment the diaphragm assembly 10 is inserted into a metal cap 4 which is substantially identical to the rigid cap 27 in my co-pending application Ser. No. 458,846. So much of this co-pending application as relates to the description of the cap 27 is incorporated herein by reference as to the description of the cap 4 in the present invention.

In another embodiment of the present invention as applied to the Fleaker flask cap, reference is made to FIG. II. In this application the diaphragm assemblies are mounted on upstanding legs 5 which are formed from base 8 which in turn is secured to the top of the Fleaker flask by a nut and bolt assembly 9. These diaphragm assemblies are inserted into slots shown in the upstanding legs 5 and are secured thereto by a washer and nut assembly 28. It would be noted again that the conduits 22 provide the threaded means for the nut and washer assembly 28. The stirring rod S in this embodiment has a surface 7 which is designed to provide some form of frictional contact with the push rods 6 which extend inwardly from the bosses of the diaphragm assemblies in lieu of the links shown in FIG. I. The end of the stirring rod in contact with the push rods may have a roughened surface or grooves and similarly the interior ends of the push rods may be grooved or given such form as will assist in maintaining contact with the portion of the stirring rod extending above the Fleaker flask.

The stirring rod is actuated by the pressure from each diaphragm assembly which is supplied cyclically with the alternating positive and negative pressures in succession. If there are only two diaphragm assemblies the system is referred to as a two-phase ACA system and if three diaphragm assemblies are used the system is referred to as a three-phase ACA system. If the two-phase system is utilized the diaphragm assemblies must be positioned on their support in such a manner that the smallest angle between them is in excess of 90°. /

The present invention also includes novel pump assemblies to provide the AC air. These pump assemblies utilize a small electric motor and means which create air pressure. These novel air pump assemblies utilize a plurality of air pressurizing chambers which are connected by various means to the shaft of the motor.

Referring now to FIG. III there is show a circular housng 65 in which an electric motor 61 is mounted with its shaft 64 vertical. A spider plate 62 with a ball-bearing race 63 is eccentrically mounted on shaft 64 by pin 68. The spider does not rotate but imposes a circular motion on the free end of each air compression capsule which is attached to the spider as shown in FIG. IV. This circular motion can be resolved into a direct push and pull on the air pressurizing chamber and a lateral motion of the air pressurizing chamber. The electric motor for example may be of a type made by CROUZET of France which has a permanent magnet rotor and revolves at 300RPM when supplied with a 50 HZ electric supply. It revolves at 360RPM on a 60 HZ electrical supply. Its power consumption is only 4 watts. The air pressurizing chambers 67 supply ACA through outlet conduit 66.

Referring now to FIG. IV, the air pressurizing chamber 67 is mounted in the wall of the container 65 and attached thereto as shown. Note the inlet conduit assembly 66 extends through the wall and through bore 71 in the air pressurizing chamber assembly. The air pressurizing chamber is formed of two flexible rubber diaphragms adhesively secured together around their periphery. The diaphragms also may be of the form shown with the stirring motor diaphragm assembly in FIGS. IX and XI. The spider 62 has three depending legs 72 from its outer periphery. The air pressurizing chambers 67 are attached to the depending legs 72 by various means, i.e., shown in FIG. IV, for example, by a screw threaded into the rubber boss on the interior end of the inner most diaphragm.

As the shaft 64 rotates each chamber is successively compressed and then expanded. This sends a positive flow of air to the stirring rod diaphragm assemblies to which the chambers connected by flexible conduits and withdraws the air from the stirring rod diaphragm assembly thus creating a negative pressure. The pump is self-contained and self-sustaining with reference to the air supply, utilizing the air captured in the wall chamber before the hoses are fitted in the diaphragm assembly and the hose when it is connected between the air pump and the stirring rod diaphragm assemblies. It is to be noted that these pumps are valveless and create no problems with friction from pistons and the like.

Another embodiment of the novel air pump assembly of the present invention is shown in FIG. V and FIG. VI. In this embodiment the air compression chambers 67 are vertically mounted on a support plate 80 which is secured to the top of the motor housing 81. It would be noted that the support plate is triangular in shape and that the air pressurizing chambers 67 are mounted at the apexes of the triangular swash plae 82 used in lieu of the spider 62 as shown in FIG. III. Referring to FIG. VI it would be noted that the swash plate 82 is mounted in an inclined relationship to the shaft 64 of the motor 61. To achieve this inclined mounting, use is made of a double reversed substantially U-shaped flat member 83 having the upper portion thereof inclined as shown. The swash plate support member 83 is secured to the shaft 64 by a nut and bolt assembly 84. A ball-bearing race assembly 85 is secured to the middle of the swash plate 82. The outer ring of the ball-bearing race 85 is attached to the swash plate 82 while the inner ring of the ball-bearing race is attached to the inclined portion of the swash plate support member 83 by the nut and bolt assembly 87 and 88. The air pressurizing chambers 87 are attached to the swash plate 82 through apertures therein by a simple nut and bolt arrangement.

It is also to be particularly noted that the novel air pumps of the present invention also differ markedly from the prior art in that the air compression and decompression chamber assemblies have no compression members which engage each other in the matter of friction such as in conventional piston and cylinder assemblies.

It is also to be observed that the novel air pumps of the present invention have air pressurizing chambers which not only move in a radial pattern due to the outward pressure of the spiders or the swash plate but also have a movement laterally in the horizontal plane particularly in respect of the embodiment shown in FIGS. IV, V and VI. In the embodiment shown in FIGS. V and VI there is also a vertical movement of the air pressurizing chambers 67. The resilient material forming the compression chambers not only eliminates the friction of the rubbing materials in the prior art compression assemblies but also may impart an additional quantity of air flow due to the flexing action of the members which may provide improved and more complete exhausting of the air from the air pressurizing chamber assemblies but also an improved negative pressure creation.

The stirring motor assemblies previously described and shown in FIG. II for use with the Fleaker flask could be utilized with the Kontes flask or flasks which employ a cap which contains a conventional screw thread inter-engaging relationships between the cap and its flask. Some modifications might have to be made in the support structure in order to attach it thereto. However, the present invention includes a novel support element for the stirring motor assemblies which facilitates its adaption to use with various types flasks.

Referring now to FIG. VII the novel support element 50 will be seen to have truncated triangular horizontal cross-section or a horizontal cross-section which might be identified as hexagonal. The element 51 has an upright leg 51 on each of the longer sides these being joined at their terminus by a second upright leg 5. Extending inwardly from the mid-portion of each upright leg 51 is a bottom tab 52. It will be noted that these tabs meet generally in the center of the underside of the element 50, there being formed by their junction a recess 55. This recess is for the insertion of the element from the stirring rod suspension diaphragm assembly which will be discussed subsequently. The pentagonal opening at each of the corners of the supporting elements 50's underside are for the purpose of inserting the supporting element over the attachment bracket for use with a Kontes flask as will also be discussed subsequently.

Referring now to FIG. VIII it will be noted that each upright leg 51 contains a vertical slot 53 which extends downwardly from the top edge 54 of the upright leg 51. The purpose of the slot is for the insertion of a stirring motor diaphragm assembly so that it can be adjustably positioned as will be discussed subsequently.

The stirring motor diaphragm assembly shown in FIGS. I and II as well as FIG. IX and FIG. XI is substantially identical with the exception of the use of the cap 4 in connection with the adaption of the stirring motor diaphragm assemblies for the supports for use with the "Fleaker"[flask.

Reference should therefore be made to FIGS. IX and XI during the course of the subsequent description.

The stirring motor assemblies are identified in FIG. IX by the letter A. Each assembly is composed of a pressure responsive working diaphragm assembly 10 and a suspension diaphragm 40 which not only carries a stirring rod in a sealed relationship but also provides the linkage which holds the suspension diaphragm assembly 40, the stirring motor diaphragm assembly A and the stirring motor assembly support element 50 together in their cooperative working relationships with each other.

The pressure responsive working diaphragm assembly 10 is comprised of a diaphragm 11 of resilient material having a solid, flexible wall 12 from which extends a centrally positioned boss 13 of the same material; a flat annular ring 14 parallel to and spaced from the flexible wall 12 but connected thereto around the outer peripheries of each to form a circular recess 15 therebetween. Into recess 15 there is frictionally and sealably fitted a disk 16 which carries a recess 17 on its inner side; i.e., facing the flexible wall 12 but spaced therefrom to form a pressurizable chamber 18 between them. Extending outwardly from the center of the outer side 19 of disk 16 is a conduit 20 for ACA supply through the disk to chamber 18. The conduit 20 has a portion 21 extending from the disk along the conduit which has screw threads and a portion 22 which carries the means to frictionally grip and hold an ACA supply tube 26 from an ACA source such as the novel air pump shown in FIGS. III–VI. A nut 28 threaded to fit portion 21 of conduit 21 is provided for assembling the diaphragm assembly 10 to the upright leg 51. A washer (not shown) such as a spacer or a lock washer may be used with the nut 28. Boss 13 has an opening 29 formed in the exposed boss face 30 into which is inserted and secured one end portion 31 of a link 32 which has an opening 33 in its free end portion to frictionlessly receive a stirring rod 34.

The diaphragm assembly 10 is mounted on bracket 50 by inserting the threaded portion 21 of conduit 20 into slot 53 on bracket leg 51 and moving the assembly along the slot until the link 32 is correctly positioned above leg 52 and nut 28 is then screwed down against the outer surface of upright leg 51 to secure the assembly 10 in its designated position. The use of slot 53 in lieu of a hole not only facilitates mounting of the diaphragm assembly 10 but also provides means for adjusting the size of the orbit described by the stirring rod when in motion.

FIG. X shows the novel support 50 with three stirring motor assemblies secured therein and also the stirring rod suspension assembly 40 which ca be seen only from the underside of the support. Conduits leading from the stirring motor assemblies to an air pump are also seen there. The stirring rod suspension assembly can best be seen in FIG. XI and will be described with reference to that figure. In FIG. XI there will be seen an illustrative container C which has a rigid plastic closure cap B. The cap may have a washer B1 inserted between the cap and the container to provide a better seal depending upon the nature of the surface of the opening of the container seal.

The stirring rod suspension diaphragm assembly 40 has a diaphragm of resilient material substantially identical to that described above in connection with the stirring motor diaphragm assembly 10, and thus the same reference numerals are used in describing both with the exception of the opening in the boss 13. The boss 13 of assembly 40 has a passageway 41 formed therein to communicate with the recess 15 in the diaphragm 11. The diameter of the passageway 41 is slightly less than the diameter of the stirring rod 34 which is inserted therethrough and pushed on until the upper portion of the stirring rod is sufficiently above the surface of the tab 52 in the support 50 to be inserted through opening 33 in link 32. With the relative diameter relationships just described, the stirring rod 44 is not only sealingly held in the diaphragm 11, but the gripping action of the boss 13 results in the boss 13 being a pivotal zne for the stirring portion of the rod which depends below the boss into the liquid in the container. The lateral distance the lower end of the stirring rod moves from the vertical — in a state of rest — is directly proportional to the ratio of the length of the stirring rod below boss 13 to the length of the stirring rod above the boss. This ratio can be varied in two ways: firstly, by changing the position of the stirring motor diaphragm assembly 10 along slot 53 in the upstanding leg 51; and secondly, with the stirring motor diaphragm assembly 10 in a set position, moving the stirring rod 34 up and down through the boss 13.

Disk 16 in the stirring rod suspension diaphragm assembly 40 is substantially identical to disk 16 in assembly 10. Conduit 42 on disk 16 of the assembly 40 differs from conduit 20 on disk 16 of assembly 10 in that the inner bore 43 is larger than the inner bore of conduit 20. This is necessary because of the amplitude of oscillation of the position of the stirring rod 34 above the boss 13 as the rod is moved by the stirring motor diaphragm assembly 10. Conduit 40 has only the threaded portion 44 which serves the same purpose as threaded portion 21 on conduit 20 of assembly 10. A nut 45 is provided for threaded portion 4.

The closure B as illustratively shown in the drawings is a conventional phenolic resin cap having interior threads which match the threads on the flask in accordance with the standards of the Glass Containers Manufacturers Institute. Another type of cap is made of polycarbonate material with tapered tubulation to fit standard ground glass joint-type flasks. These and similar rigid plastic caps are readily adaptable for use with the present invention. Tapered silicon rubber stoppers well known in the cell culture art and illustratively shown in FIGS. XXII-XXVI herein may also be readily adapted for use with the present invention. The only requirement for use with any of the closures described above is that a hole be bored in the upper surface of each cap or stopper for the insertion of conduit 42. Should subsequently disclosed flasks differing from those currently known in the art be developed, those of skill in the art will be able to readily adapt the present invention relating to stirring apparatus and its adaption to known closures for current flasks without departing from the scope of the present invention as disclosed and claimed herein.

In the operation of a three-phase system of the present invention a low pressure flow of ACA of positive and negative pressures flows from a source such as one of the air pumps disclosed in FIGS. III and VI through tubing 26 of a first of the stirring motor assemblies into its conduit 20 and then into chamber 18. The positive pressure in the chamber of this first assembly causes its flexible wall 12 to move away from the disk 16 thereby initially moving link 32 in a substantially horizontal plane along a straight path away from the diaphragm assembly. Since the flow of ACA is cyclic among the three stirring motor assemblies the second assembly will begin to receive its flow of positive pressure and this will cause its link to begin to move inwardly. This will then cause a lateral displacement of the link of the first assembly from its initial straight path. Then the cyclic flow will enter the third stirring motor assembly and the movement of its link will subsequently begin to affect the motion of the first link. In all probability it appears that if one of the motor assemblies is under full pressure the next cyclic one is under third pressure positive and the remaining one is under two-thirds negative pressure thus the combined influence on their respective links is to cause the upper portion of the stirring rod which protrudes through the links to move in an orbital path which will vary between circular and elliptical. This is believed to be caused by the fact that when the negative pressure is applied to the respective stirring motor assembly it begins to withdraw the link of that assembly towards its diaphragm in a more or less direct path. However, the pressures in the other assemblies distort that and as a result it appears that a portion of the flexible wall 12 on the side of the diaphragm lying in the direction of the lateral movement as the link is withdrawn may be slightly depressed by the boss 13 while a portion of the flexible wall lying on the other side of the boss of that assembly may be distended slightly by distortion caused by the movement of the boss 13 and supplemented by a positive pressure flow beginning or by a completion of a negative flow. The application of negative pressure will cause the depressed portion to depress further and earlier than the distended portion. This, in turn, will bring the upper portion of the rod back along an arcuate path to the initial straight line path from which the link moved and then continue as an arcuate path until the negative pressure flow ceases in that particular stirring motor diaphragm assembly. The lower portion of the stirring rod in the liquid will follow the same path as the upper portion but in reverse direction and with increased amplitude in accordance with the ratio of the length of the upper portion of the stirring rod, i.e., that portion above the boss, to the lower portion as discussed above.

When applying the stirring rod mechanism discussed with reference to FIGS. VII–XI on a Kontes flask a special attachment to the flask is provided by the present invention. Referring to FIG. XI the flask is indicated by K and attached thereto at the neck just below the flask opening is an Oetiker hose clip 100 which is fitted around its periphery with two diametrically positioned 37 ears" 101. To receive and hold the assembled stirring mechanism of the present invention there is provided a flat stainless ring 102 which carries three 120° spaced vertically upstanding stainless steel rods 110. Plate 102 is secured to the Oetiker clip 100 by nut and bolt assemblies 103 passing through the ears 101 and openings in the flat plate 102. Shown in FIG. XI along side flask K is a stirring assembly fully ready for insertion into the flask. The assembly is inverted and placed over the three rods 110 which pass through the pentagonal opening 56 as seen in FIG. X. Ring 102 has an opening which is the exact diameter of the inner portion of the neck of the flask. The stirring rod suspension assembly 40 provides a seal for use with the Kontes flask in the following manner. Flexible wall 12 with reference to FIG. XI of diaphragm 11 provides a sealing surface in that a circular surface 46 on the outer periphery of the wall 12 is fitted to the top portion of the flask and a circular ring portion 47 adjoining the inner edge of surface 46 extends downward into the opening of this flask. The triangular lid shown as 111 in FIG. XII is then fitted over the upstanding posts 110 and through openings 112 and conventional nut and washer assemblies are used to tighten the lid down over the support element 50 in this position on the upright post 110. The continual tightening of these nut assemblies will compress the surface 46 of diaphragm 11 against the opening of the flask in order to provide a satisfactory seal. Once assembled to the flask the motor may then be utilized to operate the stirrer either in a vertical position or in a inclined position as shown in FIG. XIII.

FIGS. XV–XVII show yet another embodiment of support for the stirring motor diaphragm assemblies of the present invention, especially related to use with a Kontes flask. In this embodiment the stirring motor assembly 90 is mounted with the stirring motor diaphragm assemblies mounted horizontally rather than vertically as shown in FIGS. VII–XI. Each stirring motor diaphragm assembly is identical to that shown in FIG. I and FIG. II and as described with reference to FIGS. I, II, IX and XI, but only in the latter with reference to the use of the stirring rod suspension diaphragm assembly of FIG. XI.

In this embodiment the stirring motor assemblies F are mounted on a triangular plate 120 which has a central opening of a diameter equal to the inner diameter of flat annular ring 14 of diaphragm 11 as seen in FIG. XI. The stirring motor diaphragm assemblies F are mounted equal distance on plate 120 through openings 121 therein with the use of a spacing washer 122 between the cap 4 on the assembly F and the plate 120. A substantially triangular shaped spider plate 92 connects the bosses of the three stirring motor diaphragm assemblies F by means of bolt and nut assemblies inserted into the bosses. In lieu of links or push rods as shown for FIGS. I and II use is made of a rubber stopper 94 in the center of the spider 92 to hold the upper end of the stirring rod S.

The flask is fitted with the Oetiker ring 100 and accompanying ears 101 as shown in FIGS. XI–XIII the plate being modified slightly by the creation of three equi-spaced recesses 103 to receive the threaded portions 26 on the conduits 22 from each of the stirring motor diaphragm assemblies F which are mounted on the stirring motor assembly 90. The stirring motor assembly 90 is secured to the plate 102 by means of the nuts 108 which are threaded upon portions 26 of conduit 22. The stirring rod suspension diaphragm assembly 40 which cannot be seen in this figure bears against the underside of plate 120 in manner similar to that employed with the plastic caps. When the stirring motor assembly 90 is placed on the Kontes flask and secured thereto the pressure of the motor assembly 90 being pulled down onto the plate 102 by the nuts 108 provides the same seal for the mouth of the Kontes flask as was the case with the stirring motor embodiment shown in FIGS. XI–XIII. After the stirring motor assembly 90 has been secured to the flask K the hoses 109 are then secured to the conduits 22 by conventional means.

It is to be noted in this embodiment that the movement of the stirring motor diaphragm is not only in a vertical direction but is also in a lateral direction due to the movement of the spider and the flexibility of the diaphragm itself.

FIG. XVIII shows in more detail the relationship between the stirring rod suspension diaphragm 40 and the suspension plate 120 for the stirring motor assembly 90 of FIG. XVI. It will be apparent to those of skill in the art that this particular embodiment can also be employed with the rigid plastic threaded cap or other rigid closures for flasks merely by the insertion of the cap or stopper between the stirring rod suspension assembly 40 and the underside of the support plate 120 for the stirring motor assembly 90.

In FIG. XVIII wll be seen a modification for the insertion of the plug to hold the stirring rod as seen originally in FIGS. I and II. In this instance in lieu of the solid rubber plug shown in those figures by the numeral 2 there is inserted a plastic nipple 130 having some sort of roughened outer edges 132 which grip the inner side of the bore 3 in the Fleaker stopper G. At the upper end of the nipple 130 is an annular extension 131 which is fitted inside the diaphragm 11 in the same manner in which disk 16 is fitted in diaphragm 11 as shown in FIG. XI.

Referring now to FIG. XIX it will be seen at the upper portion of this figure the stainless steel cylinder 1 which is force fitted around the Fleaker flask G and is as seen in FIG. I. The openings in the vertical wall of the cylinder 1 to receive the conduits 22 for the stirring motor diaphragm assemblies is identified as 1'. In fitting the stirring motor assembly shown in FIG. 1 to a Fleakerflask stopper for a flask having a capacity in excess of 800 milliliters certain modifications have to be made to the stainless steel housing 1. The stopper for the larger Fleaker flask comprises an inner rubber stopper which is of the same diameter as the smaller flasks and is identified as 142 in FIG. XIX and FIG. XX. The rubber stopper 142 is surrounded by a polypropylene ring 141. The rubber stopper 142 has on its underside equi-spaced protuberances shown in FIG. XX as 144. The cylinder 1 is modified for use with the stopper assembly 140 by cutting the lower portion of the cylinder away so as to provide for equi-spaced tabs 143 which have the same width as the protuberances 144 on the stopper 142. The presence of the protuberances on the stopper 142 provides less tensioning of the stopper 142 within the ring 141 which permits the relatively easy insertion of the tabs 143 between the stopper 142 and the ring 141.

FIG. XXII shows the use of the stirring motor described in FIGS. VII-XI with a neoprene stopper 150. This stopper is hollow and has attached to the bottom end thereof by any conventional adhesive means a diaphragm 51 into which is inserted the stirring rod S as was done with the diaphragm 11 of the stirring rod suspension assembly 40 in FIG. XI. In this stopper embodiment a bore is formed in the upper surface of the stopper as can be seen in FIG. XXIII and there is inserted into this bore a threaded nipple 152 which protrudes above the upper surface of the stopper so that the stopper may be secured to the tabs of the support element 50 by means of a conventional nut and washer assembly indicated as 153 in FIG. XXII.

FIGS. XXIV-XXVI disclose yet another type of neoprene stopper which may be utilized with the support elements shown in FIG. XXII. This particular stopper 160 differs from the stopper shown in FIGS. XXII and XXIII in that there is provided a skirt element 163 which depends from the outer periphery of the stopper. In this particular stopper again a diaphragm 161 is adhesively secured to the underside of the stopper to sealingly hold a stirring rod S. The stopper shown in FIGS. XXII and XXIII fits straight into the tapered top of a Kontes bottle and can eliminate the need for the assembly unit shown in FIGS. XI-XIII. The stopper assembly 150 may also be employed with the stirring motor assembly 90 as shown in FIG. XVII.

The stopper assembly 160 provides an even tighter seal when used with a Kontes flask or any flask which will receive it. The outer skirt 163 provides an extraordinarily tight seal around the neck of the flask but accordingly is much harder to remove.

The stirring rod for use with the stirring motor assemblies disclosed in this application is substantially identical for all embodiments. While one could use a rod with one or more protrusions on it in the region where it passes through the rubber diaphragm or the stopper it has been found better to use a smooth rod of a greater diameter in this region. The protrusions are troublesome to make and tend to encourage movement between the rubber stopper or boss on the diaphragm and the rod which is undesirable as it not only affects the amplitude of movement of the stirring but under certain conditions could cause slow leakage. What is required is an elastic displacement in the surrounding rubber and the avoidance of all relative motion at the interface between the rubber and the glass rod.

An essential feature of the design of the relationship of the rod and the supporting rubber diaphragms utilized in this invention is that the moment of inertia of the system which consists of the rod, the links or other means to move the rod and the rubber diaphragms to be so related to the restoring force exerted by the diaphragms or by the rubber stopper gripping the rod that resonance takes place. Resonance is essential; it is a sine qua non. The liquid ensures that the resonance peak is a flat one so that the dimensions necessary to achieve it are not terribly critical. An analysis of the situation indicates that as a rough rule (all other variables being constant) all rods with the same value of D (squared) times SL (cubed) (D ' diameter, SL is the stirring rod length below the stopper or diaphragm) or of the value of D times SL times the square root of 1 will give resonance. This resonance value of D times SL times the square root of 1 can be found by picking out a rod which is too long and cutting bits off its bottom end until it resonates. Then one computes the value of D for a rod of that length SL which just fits the flask. Since the diameter of the rod has to vary with the lengths below the stopper or diaphragm to maintain a constant movement of inertia, the lengths of rod of the required diameter is sealed to a short, for example 2 ½ inch, length of 5 millimeter rod which passes through the stopper or diaphragm and through the connecting links from the stirring motor diaphragm assemblies. This permits standardization on the dimension of connecting links irrespective of the diameter of the portion of the rod that does the actual stirring in the liquid. It also enables the selection of a short lengths which fits the standardized hole in the connecting links.

While the principles of the present invention have been illustratively described, these principles and such modifications and adaptations thereof as may subsequently occur to those skilled in the art are encompassed by the following claims.

I claim:

1. An oscillatory stirring apparatus for liquids in a container comprising a stirring assembly attachable to said container and means to supply at least two cyclically alternating flows of air under positive pressure and negative pressure to said stirring assembly, said stirring assembly comprising a housing containing at least two pressure-activated chambers spacedly arranged within said housing, a stirring rod dependingly supported within said housing, means interconnecting a portion of said rod within said housing with each of said chambers, means on the exterior of said housing to connect said chambers to said air flow supply means and means to secure said housing to said container in sealing relationship with an opening in said container.

2. The apparatus according to claim 1 wherein said container is a "Fleaker" flask having a cap/stopper assembly comprising a cylindrical shell and an insert of a resilient material within said shell to provide a seal for the opening of said flask, said insert having a central bore into which is fitted a flexible member having a central opening to sealingly receive and retain said stirring rod, said housing securing means comprising an extension of said housing which is fitted to the exterior of said shell.

3. The apparatus according to claim 2 wherein said housing is a cylinder having an inside diameter equal to or slightly less than the outside diameter of said shell, said pressure-activated chambers being spacedly mounted on the interior wall of said housing with radial angle of more than 90° and less than 180° between adjacent chambers, said interconnecting air supply means comprising a conduit for each chamber passing through the wall of said housing and the wall of said chamber in contact with said housing and means to secure said conduit to said housing wall.

4. The apparatus according to claim 3 wherein said housing comprises a flat base in the shape of an equilateral triangle with blunted apexes and a triangularly shaped vertical wall upstanding from each side of said base with means to lockingly receive one of said chambers with an air supply conduit attached in each wall and a central bore in said base to receive said rod, said housing securing means comprising an opening in each apex to receive means to secure said base to the upper surface of said cap/stopper assembly.

5. The apparatus according to claim 2 wherein said housing securing means comprises a plurality of downwardly extending tabs on said housing, said tabs being inserted into the upper surface of said cap/stopper assembly.

6. The apparatus according to claim 2 wherein the central bore in said insert is fitted with a flanged sleeve lockingly engaging the walls of the bore and said flexible member comprises a circular diaphragm fitted over said sleeve flange.

7. The apparatus according to claim 1 wherein said container is a "Kontes" type flask, said housing comprising a flat base in the shape of an equilateral triangle with blunted apexes and a triangularly shaped vertical wall upstanding from each side of said base with means to lockingly receive one of said chambers with an air supply conduit attached in each apex of said base, a circular diaphragm of resilient material secured to the under surface of said base by means of a disc fitted into an annular recess in the upper side of said diaphragm, said disc having a central bore which is fitted with a hollow cylindrical extension which extends through the bore in said base, the diaphragm being secured to said base by locking means fitted onto said cylindrical extension, said stirring rod being sealingly inserted through said extension into and through a bore in said diaphragm, said thus secured diaphragm acting as a stopper for said flask, said housing securing means comprising a resilient band around the neck of said flask, said band including a pair of diametrically position loops formed thereon, a flat annular ring with a central opening positioned on said neck opening to receive and retain said diaphragm and means to secure said ring to said loops, said ring further having three equally spaced rods extending upwardly from the ring surface opposite the surface in contact with said neck, said three rods receiving for said housing openings in the apexes of said base, a triangular lid fitted over said rods after said housing has been emplaced thereon and means operable with said rods to secure said housing on said rods.

8. The apparatus according to claim 7 wherein said container is a flask having screw-threads formed on the outer surface of the neck thereof to receive a cap having matching screw threads and said housing securing means comprising a central bore in the top of said cap, said housing being placed on top of said cap, said diaphragm with said disc and said extension being inserted into the underside of said cap whereby said extension is passed through the bore in said cap and the bore in said base to be engaged by said locking means.

9. The apparatus according to claim 7 wherein said housing comprises an upper and a lower triangularly shaped plate, one wall of each of said chambers being secured to each apex of said upper plate, the opposite wall of each chamber having an air supply conduit connected thereto and secured to each apex of said lower plate whereby said plates are resiliently spaced apart by said chambers, said upper plate having a central bore to receive a resilient plug which has an opening to receive said stirring rod, said lower plate having a central opening through which a cylindrical extension from a disc which is lockingly fitted into a circular flexible diaphragm on the underside of said lower plate is extended and lockingly secured to the upper surface of said lower plate, said diaphragm havng an opening to sealingly receive said stirring rod, said housing securing means comprising a resilient band around the neck of said bottle with opposing loops formed on said band, a flat ring secured to said loops, a central opening in said ring to receive and retain said diaphragm as a seal for said flask opening, openings around the periphery of said ring to receive the air supply conduits when the housing is lowered onto said ring and means cooperating with said conduits to secure said housing to said ring.

10. Apparatus according to claim 9 wherein said container is a flask having screw-threads formed on the neck exterior to receive a cap having matching screw-threads, said housing securing means comprising a central bore in said cap into which bore the cylindrical extension with the diaphragm attached thereto is inserted from the underside of said cap, the housing is emplaced on the cap over the extension and secured thereto by means cooperating with said extension.

11. The apparatus according to claim 1 wherein said interconnecting means comprise a flat, linking member for each chamber, one end of said member being secured to said chamber, the opposite end having an opening to receive said red.

12. The apparatus according to claim 11 wherein said interconnecting means comprise a push rod for each chamber, one end being secured thereto, the opposing end being in engagement with the surface of said rod.

13. The apparatus according to claim 1 wherein said air supply means comprises at least two air pressurizing chambers of flexible material, means for the mounting thereon of said chambers in equally-spaced relationship, air conduit means extending from the interior of each of said chambers through said mounting means and secured to the exterior surface of said mounting means, a motor with its shaft vertically secured to said mounting means, a flat plate eccentrically mounted on said motor shaft, means to connect the edges of said plate to said chambers and flexible conduits to connect said air conduit means to said pressure-activated chambers of said stirring assembly.

* * * * *